US006775500B2

(12) United States Patent
Kwak

(10) Patent No.: US 6,775,500 B2
(45) Date of Patent: Aug. 10, 2004

(54) LIQUID IMAGE FORMING SYSTEM AND METHOD FOR FORMING IMAGE USING THE SAME

(75) Inventor: Jin-geun Kwak, Cyeonggi do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/377,777

(22) Filed: Mar. 4, 2003

(65) Prior Publication Data

US 2004/0009012 A1 Jan. 15, 2004

(30) Foreign Application Priority Data

Jul. 12, 2002 (KR) ..... 2002-40667

(51) Int. Cl.[7] ..... G03G 15/10
(52) U.S. Cl. ..... 399/237
(58) Field of Search ..... 399/233, 237, 399/238, 239, 240, 249, 260

(56) References Cited

U.S. PATENT DOCUMENTS 5,255,058 A 10/1993 Pinhas et al. ..... 399/237

FOREIGN PATENT DOCUMENTS

JP 09185212 A * 7/1997 ..... G03G/15/01

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A liquid image forming system including a photosensitive body on which an electrostatic latent image is formed, a developing roller which forms a contact nip with the photosensitive body, and a metering member which is closely adhered to the developing roller and regulates the developing agent to a predetermined thickness. The system includes an intermediate transfer medium onto which the image formed on the photosensitive body is transferred via a first transfer nip, and a transfer roller which forms a second transfer nip with the transfer medium. A pressure applied to the contact nip is less than 1.2 times a pressure of the metering member on the developing roller. A pressure applied to the first transfer nip is less than 1.2 times the pressure applied to the contact nip. A pressure applied to the second transfer nip is less than 1.5 times the pressure applied to the first transfer nip.

20 Claims, 3 Drawing Sheets

LIQUID IMAGE FORMING SYSTEM AND METHOD FOR FORMING IMAGE USING THE SAME

CROSS-REFERENCE TO RELATED APPLICATIONS

This application claims the benefit of Korean Application No. 2002-40667, filed Jul. 12, 2002, in the Korean Intellectual Property Office, the disclosure of which is incorporated herein by reference.

BACKGROUND OF THE INVENTION

1. Field of the Invention

The present invention relates to a liquid image forming system, the structure of which is simplified using a high-concentration developing agent, and a method of forming an image using the same.

2. Description of the Related Art

In general, liquid image forming systems radiate light onto a photosensitive body, form an electrostatic latent image corresponding to a desired image on the photosensitive body, develop the electrostatic latent image with a developing agent in which toner in powder form is mixed with a liquid solvent, and then prints the image onto a piece of paper.

FIG. 1 shows the structure of a conventional liquid image forming system disclosed in U.S. Pat. No. 5,255,058.

As shown in FIG. 1, the conventional liquid image forming system includes a photosensitive body 10 charged to a predetermined potential by a charger 14, a light scanning unit (LSU) 16 which radiates light onto the charged photosensitive body 10, forms a relative potential difference thereon, and forms an electrostatic latent image corresponding to a desired image, a developing agent-supplying unit which supplies a developing agent to the photosensitive body 10 to form the electrostatic latent image, and a transfer body 30 which transfers the image developed on the photosensitive body 10 and prints the image onto a piece of paper 72.

In general, the developing agent-supplying unit prepares a developing agent with a toner concentration of less than 3% solid and supplies the developing agent between the photosensitive body 10 and a developing roller 38. To do this, the developing agent-supplying unit includes concentrated cartridges 82 and 84, in which a concentrated developing agent of about 25% solid is dipped, and a solvent cartridge 86 in which a pure solvent is stored. The development agent-supplying unit also includes mixing tanks 55, 57, 59, and 61 which mix the concentrated cartridges 82 and 84 with the solvent to prepare a developing agent with a uniform concentration of about 2–3% solid, a supplying unit 20 which pumps the developing agent prepared in the mixing tanks 55, 57, 59, and 61 to pumps 90, 92, 94, and 96 and supplies the developing agent to the developing roller 38, and a withdrawing unit which withdraws the developing agent remaining after a developing operation. The withdrawing unit includes a collecting container 50 which collects the developing agent flowing after being supplied between the developing roller 38 and the photosensitive body 10 and returns the collected developing agent to the mixing tanks 55, 57, 59, and 61 for each color, a squeeze roller 26 which presses the photosensitive body 10 on which an image is developed, and squeezes a solvent contained in the developed image, and a separator 66 which withdraws the squeezed developing agent from the collecting container 50, separates the toner from the developing agent, and returns a solvent to a solvent tank 65.

In the above structure, in order to perform a developing operation, developing agents having four colors such as yellow (Y), magenta (M), cyan (C), and black (K), with a uniform concentration of 2–3% solid, are prepared in each of the mixing tanks 55, 57, 59, and 61, respectively. Of course, only one developing agent is prepared in a system to perform a development operation using a single color such as a black-and-white image. However, a system in which four-color developing agents are prepared so as to implement color images is disclosed here. In order to prepare developing agents for each color, the developing agent-supplying unit supplies the concentrated developing agent and the pure solvent to the mixing tanks 55, 57, 59, and 61 from the concentrated cartridges 82 and 84 and the solvent cartridge 86, thereby manufacturing a developing agent with a predetermined concentration. For this purpose, in general, a concentration sensor (not shown) is provided in each of the mixing tanks 55, 57, 59, and 61 and measures the concentration of the mixed developing agent. In this way, if developing agents are prepared for each color, the developing operation begins. First, the charger 14 charges the photosensitive body 10 to a predetermined potential. In this state, the LSU 16 radiates light onto the charged photosensitive body 10, reduces a potential thereon, thereby forming an electrostatic latent image corresponding to a desired image. Subsequently, the pumps 90, 92, 94, and 96 operate and supply the developing agents prepared in the mixing tanks 55, 57, 59, and 61 between the developing roller 38 and the photosensitive body 10 via the supplying unit 20, thereby developing the electrostatic latent image. The developed image is transferred onto the transfer body 30. If the image is an image formed of one color, the image is directly printed on the paper 72. However, if a color image is implemented with a plurality of overlapped color developing agents, an image developed for each color is overlapped on the transfer body 30 by repeating charge, exposure, and development operations for four colors such as yellow (Y), magenta (M), cyan (C), and black (K). The overlapped color image is printed on the paper 72 passing between the transfer roller 30 and a compressing roller 71.

However, as described above, the structure of the liquid image forming system requiring the operations of preparing, supplying, and withdrawing the developing agent, is very complicated. This is because a concentrated high-concentration developing agent cannot be used, but instead a low-concentration developing agent of less than 3% solid is used during the developing operation. Of course, if the developing agent is manufactured with a low-concentration and is used during the developing operation, mobility is improved, and a difference in toner density for each portion of the developed image is reduced. However, as described above, the conventional liquid image forming system requires a very complicated structure. Specifically, the concentrated developing agent and the solvent are dipped in the concentrated cartridges 82 and 84 and the solvent cartridge 86, respectively, are transferred to the mixing tanks 55, 57, 59, and 61, and are mixed with a low-concentration developing agent of less than 3% solid for development to thereby form an electrostatic latent image. Then, the solvent contained in the developed image is squeezed and withdrawn to be in a high-concentration state suitable for printing. Thus, the size of the liquid image forming system or costs are increased.

In addition, since a transfer operation of an image formed of a low-concentration developing agent is performed, even after a squeezing operation is completed, liquid may easily flow out due to a pressure applied during the transfer operation. Thus, it is quite possible that an image may be spread or dragged. Accordingly, in order to obtain a clear image, the transfer roller 30 should have a special structure having a humidity-absorption layer. Also, an additional image-drying apparatus, which prevents the image from spreading during the transfer operation by drying an image, should be further provided. Also, if the image-drying apparatus is installed, the temperature in a printer is greatly increased. Thus, in order to prevent deterioration of the performance of the photosensitive body 10, a cooler should be further installed.

Hence, a new liquid image forming system that can solve the above problems is required.

SUMMARY OF THE INVENTION

Accordingly, it is an aspect of the present invention to provide a liquid image forming system having an improved structure, in which a high-concentration developing agent is used without requiring a squeezing operation during a developing operation, and a method of forming an image using the same.

Additional aspects and advantages of the invention will be set forth in part in the description which follows and, in part, will be obvious from the description, or may be learned by practice of the invention.

The foregoing and/or other aspects of the present invention are achieved by providing a liquid image forming system including a photosensitive body on which an electrostatic latent image is formed; a developing roller which forms a contact nip with the photosensitive body and develops the electrostatic latent image with a developing agent having a color; a metering member which is closely adhered to the developing roller and regulates the developing agent on the developing roller to a predetermined thickness; an intermediate transfer medium onto which the image formed on the photosensitive body is transferred via a first transfer nip formed therebetween; and a transfer roller, which forms a second transfer nip with the intermediate transfer medium, and transfers the transferred image onto a printing medium passing between the intermediate transfer medium and the second transfer nip, wherein a pressure applied to the contact nip is less than 1.2 times a pressure of the metering member on the developing roller, a pressure applied to the first transfer nip is less than 1.2 times the pressure applied to the contact nip, and a pressure applied to the second transfer nip is less than 1.5 times the pressure applied to the first transfer nip.

The foregoing and/or other aspects are achieved by providing a method of forming a liquid image. The method includes forming an electrostatic latent image on a photosensitive body; staining a developing agent on a developing roller which forms a contact nip with the photosensitive body; regulating the developing agent to a thickness using a metering blade closely adhered to the developing roller; developing the electrostatic latent image while maintaining a pressure applied to the contact nip to be less than 1.2 times a pressure of the metering blade on the developing roller; transferring the developed image onto an intermediate transfer medium which forms a first transfer nip with the photosensitive body, while maintaining a pressure applied to the first transfer nip to be less than 1.2 times the pressure applied to the contact nip; and transferring the transferred image from the intermediate transfer medium onto a printing medium passing between the intermediate transfer medium and a transfer roller, while maintaining a pressure applied to a second transfer nip between the intermediate transfer medium and the transfer roller to be less than 1.5 times the pressure applied to the first transfer nip.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENT

Figure 1:
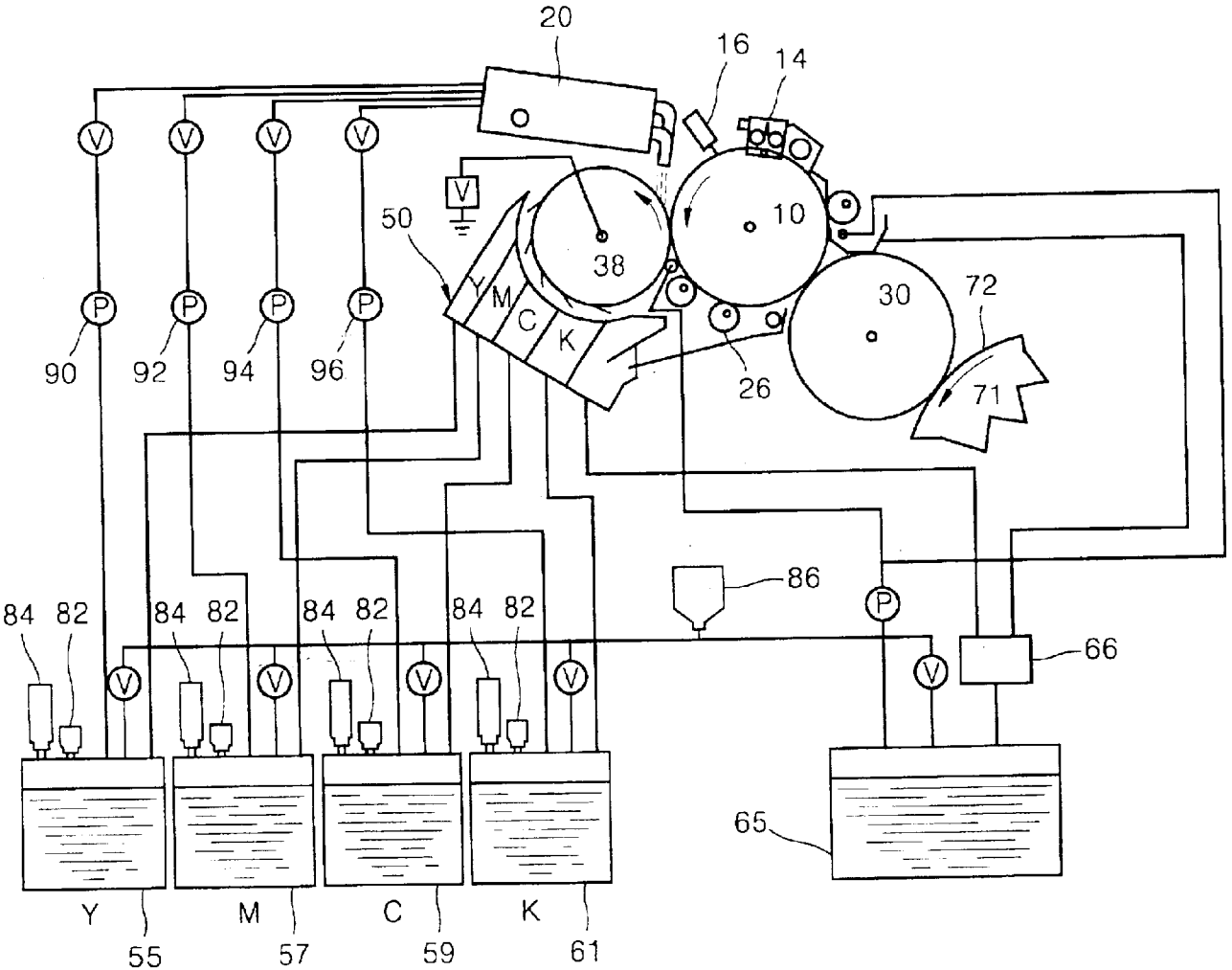
FIG. 1 (PRIOR ART)
FIG. 1 shows a conventional liquid image forming system.

Reference will now be made in detail to the present preferred embodiment of the present invention, an example of which is illustrated in the accompanying drawings, wherein like reference numerals refer to like elements throughout.

Figure 2:
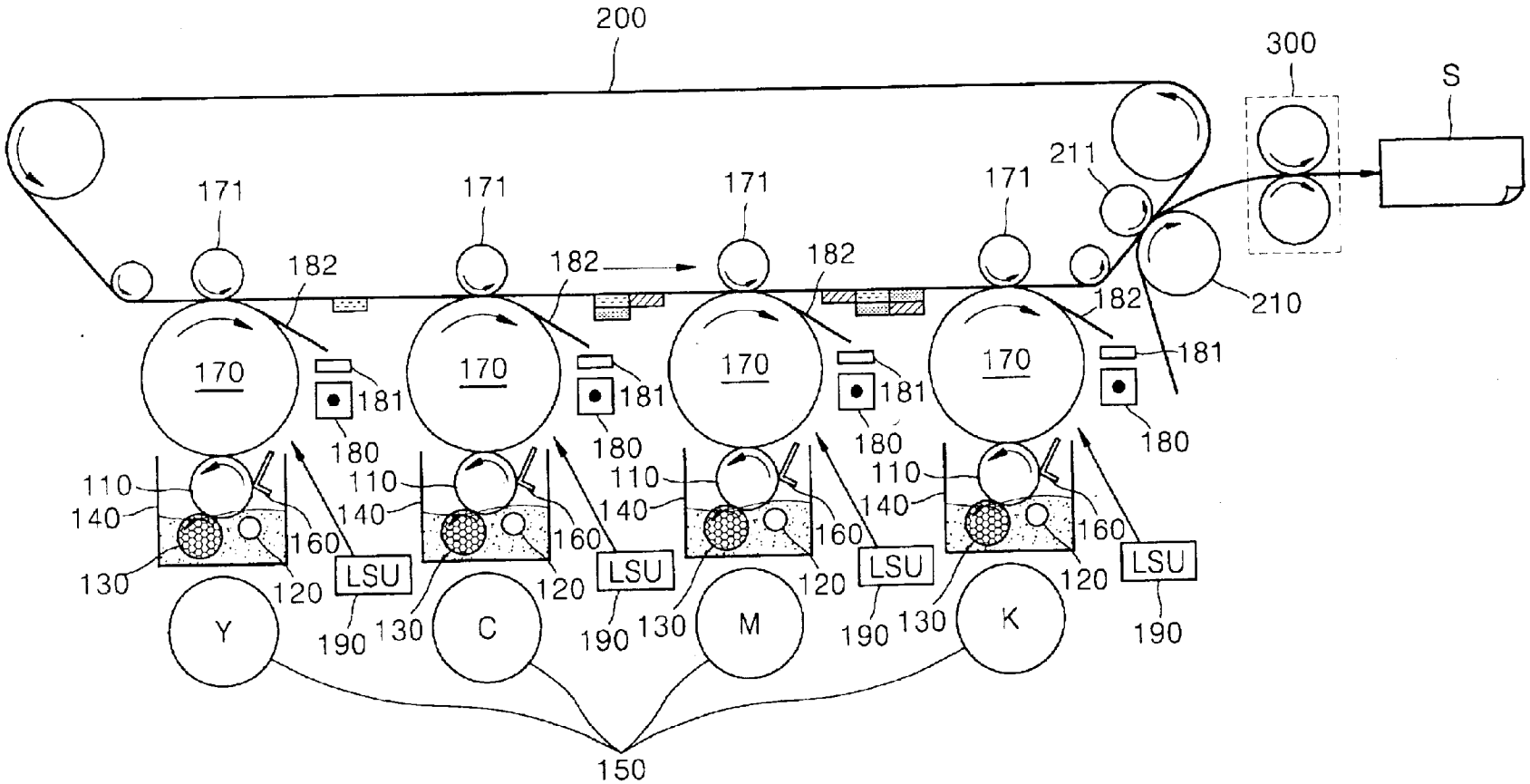
FIG. 2 shows a liquid image forming system according to an embodiment of the present invention.
Figure 3:
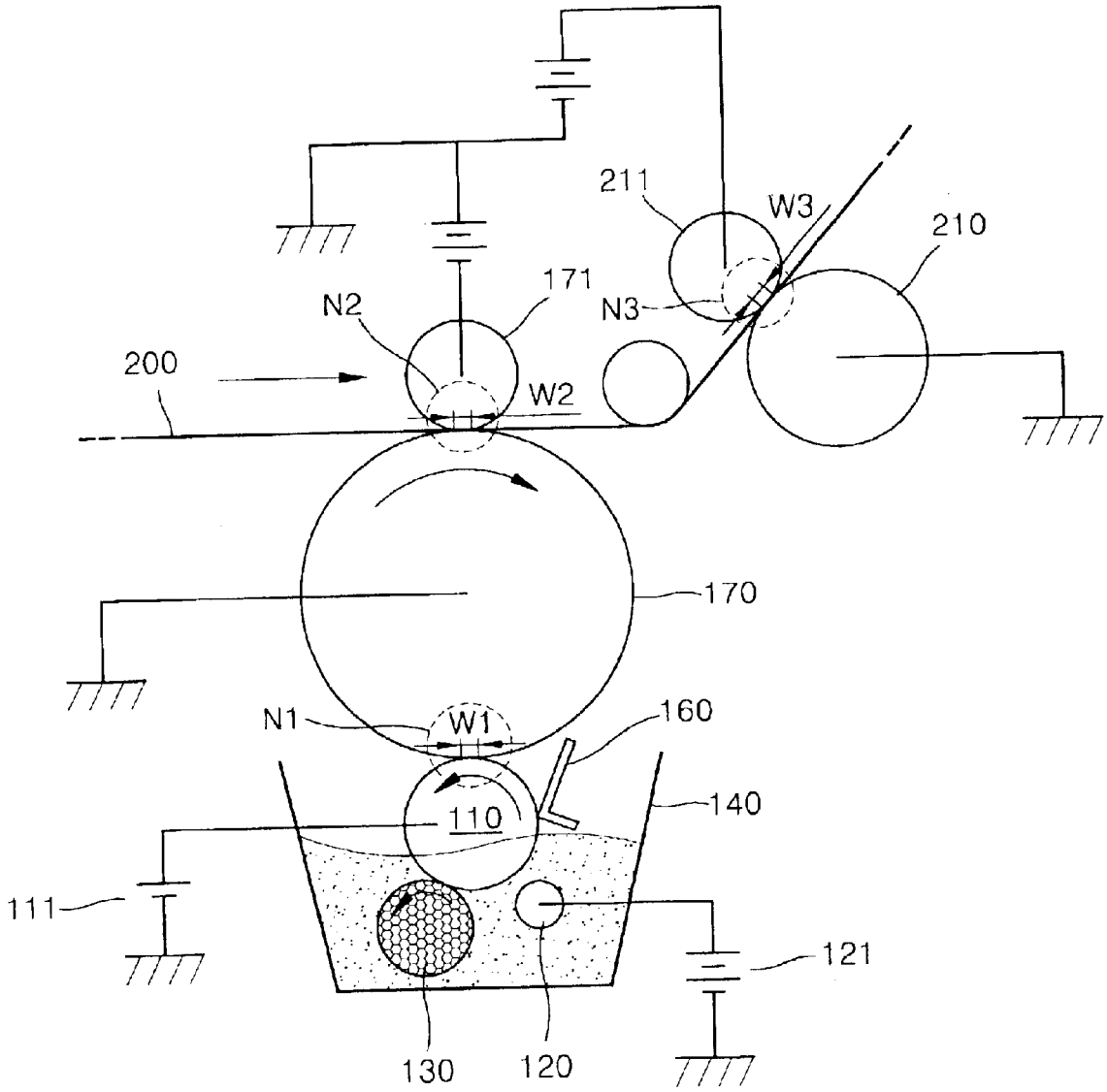
FIG. 3 shows portions of the liquid image forming system of FIG. 2.

FIGS. 2 and 3 illustrate a liquid image forming system according to an embodiment of the present invention. In some cases, a plurality of the individual elements are provided in order to print images of different colors. However, to simplify the description, only a single element will be described. The liquid image forming system includes a cartridge 150 in which a developing agent is stored, and a developing container 140 in which the developing agent supplied from the cartridge 150 is stored. A high-concentration developing agent (of 3–30% solid) is used for the developing agent supplied to the developing container 140 from the cartridge 150.

Also, as shown in FIG. 3, a developing roller 110 is in the developing container 140. Part of the developing roller 110 is dipped in the developing agent, and the developing roller 110 contacts a photosensitive body 170 and rotates. Also in the developing container 140 is a metering blade 160 which regulates the developing agent stained on the outer surface of the developing roller 110 to a predetermined thickness, a depositing unit which applies a voltage so that the developing agent is well attached to the surface of the developing roller 110, and a cleaning unit which cleans the surface of the developing roller 110.

The depositing unit includes a depositing roller 120 placed near the developing roller 110 and a power supply unit 121 which applies a voltage to the depositing roller 120. The cleaning unit includes a cleaning roller 130 which contacts the developing roller 110 and rotates in the same direction as the developing roller 110. The depositing roller 120 may be formed of a stainless material. The depositing roller 120 is dipped in the developing agent, and attaches the developing agent to the developing roller 110 by an electric force of a voltage applied by the power supply unit 121. In this case, the depositing roller 120 may contact the developing roller 110 or may be separated from the developing roller 110 by a gap of about 50–200 $\mu$m (for example, 50–100 $\mu$m). Also, the depositing roller 120 may be formed in the form of a fixed or rotating roller, or in the form of a plate having a curvature similar to the circumference of the developing roller 110. The cleaning roller 130 may be a sponge, and contacts the developing roller 110, rotates in the same direction as the developing roller 110, and cleans toner particles of the developing agent that have not been developed and are stuck on the surface of the photosensitive body 170. The developing roller 110 may be formed of polyurethane rubber or NBR as a conductive elastomer. The developing roller 110 may have a resistance of $10^5$–$10^8$ ohm, a hardness (shore A) of 25–65 degrees, and a surface roughness Ra of 1–4 $\mu$m.

Reference numeral 111 denotes a developing voltage supplying unit which applies a developing voltage to the developing roller 110, and reference numeral 200 denotes a transfer belt as an intermediate transfer medium, which transfers an image developed on the photosensitive body 170 and prints the image onto a printing medium such as a piece of paper S. Reference numeral 180 denotes a charger which charges the photosensitive body 170, and reference numeral 190 denotes a laser scanning unit (LSU) which radiates light onto the photosensitive body 170 and forms an electrostatic latent image thereon. Reference numerals 181 and 182 denote an eraser and a photosensitive body cleaning blade, respectively.

One liquid image forming system is provided in a printer using a single color, but in the case of a color printer to overlap and print a plurality of colors, a plurality of the above systems are provided.

In the above structure, in order to perform a developing operation, first, a developing agent for each color is supplied to the developing container 140 from the cartridge 150 and is charged to a predetermined level. The charged developing agent, as described above, is a high-concentration developing agent (3–30% solid, for example, 3–12% solid). If the developing agent for each color is prepared as described above, the developing operation begins. First, bias voltages of 300–550 V and 500–1550 V are applied to the developing roller 110 and the depositing roller 120, respectively. The bias voltage of the developing roller 110 is a voltage between a voltage of about 900 V applied to the photosensitive body 170 by the charger 180, and a voltage of about 100 V of a portion in which the electrostatic latent image is formed by the LSU 190. If the bias voltages are applied as described above, toner particles contained in the developing agent are positively charged. Thus, the toner particles are attached to the surface of the developing roller 110 by a difference in voltages between the developing roller 110 and the depositing roller 120. In this case, the toner particles may be electrically strong or weak and are attached to the surface of the developing roller 110. According to experiment, when a developing agent with a concentration of 3–12% solid is used, the developing agent attached to the developing roller 110 by the above electric force before passing the metering blade 160 has a concentration of 6–14% solid and a mass/area (M/A) of 400–1100 $\mu$g/cm$^2$.

When a developing agent with a relatively low concentration of 3% solid is used, the concentration of the developing roller 110 is increased two-fold, to 6% solid. Also, when a developing agent with a concentration of 12% solid is used, the concentration of the developing roller 110 is increased slightly, to 12–14% solid. However, there is a great difference in concentration of the developing agent in this state, as described above. Accordingly, if the electrostatic latent image formed on the photosensitive body 170 is developed without any changes, it is difficult to develop an image with a uniform concentration.

Thus, the developing agent stained on the developing roller 110 is scratched by the metering blade 160 to have a uniform thickness within a predetermined range. In the present embodiment, the metering blade 160 is formed of a high-elasticity stainless plate having a thickness of 0.05–0.1 mm in an L shape, so that a cut portion of the plate contacts the developing roller 110 on the surface of the developing agent. The results of experiment using a developing agent with a concentration of 3–30% solid will now be discussed. When a pressure applied to the developing roller 110 by the metering blade 160 is maintained at 50–100 g/cm$^2$, the developing agent on the developing roller 110 before the developing operation has a concentration of 17–27% solid and a M/A of 150–220 $\mu$g/cm$^2$, and therefore a comparatively uniform concentration distribution is obtained. In this case, a difference in voltage between the depositing roller 120 and the developing roller 110 is 100–500 V. Thus, even though a developing agent with a uniform concentration is not used, the concentration of the developing agent before the developing operation is nearly uniform, so that the developing agent can be used during the developing operation.

Subsequently, a contact developing operation is performed on the photosensitive body 170 using the developing roller 110 on which the developing agent with the above concentration is stained. In this case, if a very strong pressure is applied to a contact nip N1 between the developing roller 110 and the photosensitive body 170, liquid contained in a high-concentration developing agent is squeezed and may flow out. This may cause the image transferred onto the photosensitive body 170 to be spread or dragged. Thus, the pressure may be maintained within a range which does not affect the developing operation, and the width W1 of the contact nip N1 is large. According to the experiment, if the width W1 of the contact nip N1 is set to 1–3 mm and a pressure applied to the contact nip N1 is maintained to be less than 1.2 times a pressure applied to the developing roller 110 by the metering blade 160, image spreading or dragging can be prevented. In this case, the concentration of the developing agent transferred onto the photosensitive body 170 is 4–33% solid. This is a high-concentration state in which there is almost no flow of surplus solvent. Even though the squeezing operation is not additionally performed, since a state suitable for a transfer operation has been already formed, an additional squeezing operation is not needed. Also, the toner particles remaining after the developing operation are removed by the cleaning roller 130 dipped in the developing container 140.

Meanwhile, the developed image is transferred onto the transfer belt 200. If a color image is intended to be implemented, an image for each of four colors such as yellow (Y), cyan (C), magenta (M), and black (K), developed by each image forming system, is overlapped on the transfer belt 200 and is then printed on the paper S. However, assuming that a transfer operation onto the transfer belt 200 is a first transfer operation, and a transfer operation onto the paper S is a second transfer operation, pressures applied during the first and second transfer operations may affect image quality. Of course, in the present system, the developing agent transferred to the photosensitive body 170 is suitable for a transfer operation without requiring an additional squeezing operation. However, if pressures are excessively applied during the first and second transfer operations, as described previously, liquid flows out and causes the image to be spread or dragged, and thus the pressures should be properly adjusted.

According to experiment, when a first transfer nip N2 between the photosensitive body 170 and the transfer belt 200 has a width W2 of 2–5 mm, and the pressures are maintained to be less than 1.2 times the pressure applied to the contact nip N1, the pressures do not negatively affect the image. Furthermore, when a second transfer nip N3 in which the transfer belt 200 and the paper S are closely adhered between a second transfer roller 210 and a second transfer backup roller 211, the pressures are maintained to be less than 1.5 times the pressure applied to the first transfer nip N2, and image spread or dragging does not occur. Of course, if the paper S has a humidity-absorption layer, even though the pressure applied to the second transfer nip N3 is increased, image spread or dragging does not occur.

For example, assuming that a non-humidity-absorption medium such as an OHP film is used, in order to obtain high image quality, the pressures may be maintained to be less than 1.5 times the pressure applied to the first transfer nip N2, as described above. If the pressures are properly adjusted as described above, image spread or dragging can be prevented, and thus installation of an additional drying apparatus to dry an image is not needed. Here, the developing roller 110 is formed of low-hardness high-elasticity urethane rubber, and the transfer belt 200 is formed of a three-layer urethane base. The first transfer backup roller 171 is formed of a multi-layer structure having an inner layer formed of a sponge and an outer layer formed of urethane rubber, and a middle-hardness high-elasticity urethane rubber roller is used for the second transfer backup roller 210 in consideration of the surface roughness of the paper S.

The paper S on which the image is printed through the above transfer operation is heated at a predetermined temperature and is pressurized by a fusing unit 300, and is then exhausted.

In the above liquid image forming system, the high-concentration developing agent can be used during the developing operation without an intermediate diluting operation, and thus a developing agent-supplying structure can be simplified, and the squeezing operation of squeezing a surplus solvent can be omitted. Also, the developing agent stained on the developing roller during the developing operation can be maintained at a uniform concentration using the metering blade.

As described above, the liquid image forming system according to the present embodiment has the following effects.

First, a developing operation is performed by supplying a high-concentration developing agent dipped in a cartridge to a developing container without performing an additional diluting operation, thus a developing agent-supplying structure is simplified. Thus, a printer size may be small. Second, the concentration of the developing agent on the developing roller can be maintained at a uniform level using a metering blade, such that a control unit to dilute the developing agent in a mixing tank and adjust the concentration of the developing agent is not needed. Third, as the concentration of the developing agent is increased, image spread does not occur, such that high image quality is obtained. Fourth, a squeezing operation can be omitted by performing the developing operation using the high-concentration developing agent. Fifth, miniaturization and a high-speed of a printer can be implemented due to the omission of a squeezing operation. Sixth, pressures applied during the developing and transfer operations of the image are maintained at a low-pressure, wide nip state, such that the image is effectively prevented from spreading or dragging without an additional drying apparatus before a second transfer operation.

Although a few preferred embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A liquid image forming system comprising:

a photosensitive body on which an electrostatic latent image is formed;

a developing roller which forms a contact nip with the photosensitive body and develops the electrostatic latent image with a developing agent having a color;

a metering member which is closely adhered to the developing roller and regulates the developing agent on the developing roller to a predetermined thickness;

an intermediate transfer medium onto which the developed image on the photosensitive body is transferred via a first transfer nip formed therebetween; and a transfer roller, which forms a second transfer nip with the intermediate transfer medium, and transfers the transferred image onto a printing medium passing between the intermediate transfer medium and the second transfer nip;

wherein a pressure applied to the contact nip is less than 1.2 times a pressure of the metering member on the developing roller, a pressure applied to the first transfer nip is less than 1.2 times the pressure applied to the contact nip, and a pressure applied to the second transfer nip is less than 1.5 times the pressure applied to the first transfer nip.

2. The system of claim 1, wherein a width of the contact nip is 1–3 mm, a width of the first transfer nip is 2–5 mm, and a width of the second transfer nip is 2–8 mm.

3. A method of forming a liquid image comprising:

forming an electrostatic latent image on a photosensitive body;

staining a developing agent on a developing roller which forms a contact nip with the photosensitive body;

regulating the developing agent to a thickness using a metering blade adhered to the developing roller;

developing the electrostatic latent image while maintaining a pressure applied to the contact nip to be less than 1.2 times a pressure of the metering blade on the developing roller;

transferring the developed image onto an intermediate transfer medium which forms a first transfer nip with the photosensitive body, while maintaining a pressure applied to the first transfer nip to be less than 1.2 times the pressure applied to the contact nip; and transferring the transferred image from the intermediate transfer medium onto a printing medium passing between the intermediate transfer medium and a transfer roller, while maintaining a pressure applied to a second transfer nip formed between the intermediate transfer medium and the transfer roller to be less than 1.5 times the pressure applied to the first transfer nip.

4. The method of claim 3, wherein a width of the contact nip is 1–3 mm, a width of the first transfer nip is 2–5 mm, and a width of the second transfer nip is 2–8 mm.

5. A liquid image forming system comprising:

a photosensitive body on which an electrostatic latent image is formed;

a developing roller which forms a contact nip with the photosensitive body and develops the electrostatic latent image with a developing agent; and a metering member to regulate the developing agent on the developing roller to a predetermined thickness, wherein a pressure applied to the contact nip is less than 1.2 times a pressure of the metering member on the developing roller, to prevent dragging or spreading of the developed image.

6. The system of claim 5, further comprising:

an intermediate transfer medium onto which the developed image on the photosensitive body is transferred via a first transfer nip formed therebetween; and a transfer roller, which forms a second transfer nip with the intermediate transfer medium, and transfers the transferred image onto a printing medium passing between the intermediate transfer medium and the second transfer nip, wherein a pressure applied to the first transfer nip is less than 1.2 times the pressure applied to the contact nip.

7. The system of claim 6, wherein a pressure applied to the second transfer nip is less than 1.5 times the pressure applied to the first transfer nip.

8. The system of claim 5, further comprising:

a plurality of the photosensitive bodies having a plurality of the electrostatic latent images formed thereon; and a plurality of the developing rollers to develop the plurality of electrostatic images with a plurality of the developing agents, each having a different color.

9. The system of claim 5, wherein a width of the contact nip is 1–3 mm.

10. The system of claim 6, wherein a width of the first transfer nip is 2–5 mm.

11. The system of claim 6, wherein a width of the second transfer nip is 2–8 mm.

12. The system of claim 6, wherein the image transferred to the transfer roller dries without a drying apparatus.

13. The system of claim 5, further comprising a container to store the developing agent prior to being attached to the photosensitive body.

14. The system of claim 13, wherein a concentration of the developing agent in the container is 3–30% solid.

15. The system of claim 13, further comprising a depositing roller dipped in the developing agent to attach the developing agent to the developing roller.

16. The system of claim 15, wherein the depositing roller contacts the developing roller.

17. The system of claim 16, wherein the depositing roller is 50–100 microns from the developing roller.

18. The system of claim 5, wherein the developing roller is formed of polyurethane rubber or NBR, having a resistance of $10^5$ to $10^8$ ohms, a hardness of shore A 25–65 degrees, and a surface roughness of 1–4 $\mu$m.

19. The system of claim 15, wherein the depositing roller is a fixed or rotating roller.

20. The system of claim 15, wherein the depositing member is a plate having a curvature similar to a circumference of the developing roller.

* * * * *